US005547832A

United States Patent [19]

Yarmey et al.

[11] Patent Number: 5,547,832

[45] Date of Patent: Aug. 20, 1996

[54] METHOD FOR HARDENING PHOTOGRAPHIC MATERIALS

[75] Inventors: Marianne Yarmey, Florence, Mass.; James L. Bello; Gary F. Mitchell, both of Rochester, N.Y.; Glenn T. Pearce, Fairport, N.Y.; Wayne A. Bowman, Walworth, N.Y.; Melvin Sterman, Pittsford, N.Y.

[73] Assignee: Eastman Kodak Company, Rochester, N.Y.

[21] Appl. No.: 909,797

[22] Filed: Jul. 7, 1992

[51] Int. Cl.[6] ..... G03C 1/005; G03C 1/494

[52] U.S. Cl. ..... 430/623; 430/621; 430/935

[58] Field of Search ..... 430/623, 621, 430/628, 935, 642

[56] References Cited

U.S. PATENT DOCUMENTS

| | | | |
|---|---|---|---|
| 3,220,844 | 11/1965 | Houck et al. | 96/85 |
| 3,220,849 | 11/1965 | Baden et al. | 96/111 |
| 3,926,869 | 12/1975 | Horie et al. | 260/8 |
| 4,063,952 | 12/1977 | Himmelmann et al. | 96/111 |
| 4,067,741 | 1/1978 | Bergthaller et al. | 96/111 |
| 4,113,903 | 9/1978 | Choinski | 427/420 |
| 4,119,464 | 10/1978 | Saverteig et al. | 96/68 |
| 4,233,398 | 11/1980 | Nittel et al. | 430/495 |
| 4,590,151 | 5/1986 | Arter et al. | 430/537 |
| 5,034,249 | 7/1991 | Reif et al. | 430/623 |
| 5,187,259 | 2/1993 | Sterman et al. | 530/354 |
| 5,229,260 | 7/1993 | Takamuki et al. | 430/623 |
| 5,391,401 | 2/1995 | Blake et al. | 427/420 |

FOREIGN PATENT DOCUMENTS

| | | |
|---|---|---|
| 0315109 | 5/1989 | European Pat. Off. . |
| 0370226 | 5/1990 | European Pat. Off. . |
| 1275587 | 5/1972 | United Kingdom . |
| WO91/15526 | 10/1991 | WIPO . |

*Primary Examiner*—Geraldine Letscher
*Attorney, Agent, or Firm*—William J. Scanlon

[57] ABSTRACT

Methods and compositions are provided for hardening with fast-acting hardeners the colloidal carrier materials, such as gelatin, in the layers of photographic materials, such as photographic film. The methods of the invention comprise coating, with a conventional coating technique, among the layers of a photographic material a layer of a composition of the invention. The compositions of the invention are aqueous solutions which comprise a fast-acting hardener and a polymeric thickener, have concentrations of thickener less than about 50 mg/cm$^3$ and, at 40° C. and shear rates between about 1000 sec$^{-1}$ and 10,000 sec$^{-1}$, have viscosities from about 5 cp to about 20 cp and power law indices greater than about 0.90.

3 Claims, No Drawings

METHOD FOR HARDENING PHOTOGRAPHIC MATERIALS

TECHNICAL FIELD

This invention relates generally to the preparation of photographic materials, such as photographic film or paper. More particularly, the invention relates to hardening with fast-acting hardeners of the colloidal carrier material, such as gelatin, used in the layers, of which the photographic materials are made. The invention concerns methods and compositions for such hardening.

BACKGROUND OF THE INVENTION

Advances in photography in the past two decades are attributable, in large part, to advances made in the technology of hardeners. These advances in hardener technology have made possible, in photographic processing, the use of higher solution temperatures and the combination or elimination of one or more steps.

Photographic materials typically have several photographic layers, such as silver halide emulsion layers, protective layers, filter layers, intermediate layers, and undercoating layers, layered or coated successively on an underlying layer of support material, such as a paper; cellulose ester, acetate or acetobutyrate; polyester; polycarbonate; glass; metal; or the like. The photographic layers are typically aqueous solutions of polymers, such as gelatin, in which other components, such as dyes, color couplers, sensitizers, silver halide crystals, or the like, as well understood in the photographic arts, are dissolved or dispersed. Among other functions, the polymer in the layers provides a modicum of structural integrity to the layers and the photographic material consisting of the layers.

During processing, after exposure, photographic materials are typically passed through several aqueous solutions, all of which may have different pHs and possibly elevated temperatures. In the course of this processing, the layers of a photographic material must not dissolve, swell excessively, delaminate or separate from the support. If any of these result, the performance of the photographic material is severely compromised. The layers of a photographic material must thus be made resistant to such degradative processes Resistance to such processes is achieved in part by "hardening" the layers.

"Hardening" a layer of a photographic material means treating the layer so that it acquires a higher "melting point", i.e a higher temperature required for dissolution of the layer in water "Hardening" entails crosslinking molecules of the polymers, such as gelatin, which serve as "binders" or "colloidal carriers," in the photographic layers.

A variety of substances are capable of reacting with the protein molecules of gelatin to effect crosslinking and, thereby, hardening of layers in photographic materials. Such hardeners include salts of certain metals, such as zirconium and chromium salts; bifunctional aldehydes, ketones, sulfonate esters, sulfonyl halides, carboxylic acid derivatives, and carbonic acid derivatives; carbodiimides; and isoxazolium salts See, e.g. James, The Theory of the Photographic Process, 4th ed. (1977), pp. 77–87. The use of these so-called "conventional" hardeners, however, involves a number of problems.

One problem common to most conventional hardeners is their relatively slow rate of reaction with the gelatin, resulting in hardening over a prolonged period of time. Such slow reaction velocity results in afterhardening, ie, increased hardening upon storage of the photographic materials, causing sensitometric changes such as reduction in contrast To attempt to solve this problem, so-called "fast-acting hardeners" (also known as rapid-acting hardeners or quick-acting hardeners) have been described and used.

These fast-acting hardeners have a high reaction rate in crosslinking gelatin and cause hardening within a relatively short time after their addition to gelatin solutions. With fast-acting hardeners, it is possible to avoid afterhardening during storage of photographic materials.

Many fast-acting hardeners have been described. For example, U.S. Pat. No. 4,119,464 describes certain carbamoylonium compounds, carbamoylpyridinium and carbomoyloxypyridinium salts. U.S. Pat. No. 4,067,741 discloses the use of certain sulfonyl pyridinium compounds, while U.S. Pat. No. 4,063,952 discloses the use of sulfo- or sulfoalkyl-substituted carbamoyl pyridinium compounds. European Patent Application Publication No. 257,515 discloses hardeners which are carbamoyl and ureido compounds.

However, fast-acting hardeners react so quickly with gelatin that they pose several other problems in the production of photographic materials. For example, the use of fast-acting hardeners causes difficulties in the coating of the photographic layers in such production. When fast-acting hardeners are added to a solution to be coated, their reaction with gelatin may be so rapid that hardening takes place in the coating hopper apparatus, producing slugs of hardened gelatin and resulting in nonuniform coatings.

Thus, it would be desirable to provide a delivery system for fast-acting hardeners which would allow rapid hardening of coated gelatin-containing layers as compared to conventional hardeners, yet avoid the onset of premature hardening within the coating hopper.

Approaches have been described to avoid the problems arising from the short reaction time of fast-acting hardeners. For example, U.S. Pat. No. 4,233,398 discloses the incorporation of a polysaccharide with a fast-acting hardener which can then be coated on top of a gelatin layer to be hardened. U.K. Patent No. 1,275,587 discloses the addition of copolymers of acrylic acid and an alkyl acrylate in the layers containing the fast-acting hardener. However, U.S. Pat. No. 4,233,298 discloses that use of such compounds increases swelling in the layers, especially when used with carbodiimide and isoxazolium hardeners.

Further problems for the use of fast-acting hardeners are presented by the need for compatibility, of whatever chemical or physical measures are taken to control excessively rapid hardening, with methods used to coat layers in the course of making a photographic material and with preservation of the sensitometric quality of a photographic material.

SUMMARY OF THE INVENTION

The present invention provides methods, for hardening of photographic layers in a photographic material using a fast-acting hardener, which reduce or eliminate problems associated with excessively rapid hardening, are compatible with the conventional bead-coating and curtain-coating processes for coating layers in preparing photographic materials, and do not adversely affect the physical or sensitometric properties of photographic materials.

Aqueous solutions for carrying out the methods of the invention are also provided.

The invention rests on the discovery that there are combinations of fast-acting hardeners and polymeric materials (thickeners) which can be used to make aqueous solutions which (a) are fairly Newtonian (power law index greater than about 0.9) at the temperatures, above about 35° C. and typically at about 40° C., and at the shear rates to which solutions to be coated are exposed during conventional bead-coating and curtain-coating processes for coating layers in making photographic materials; (b) have viscosities at such temperatures and shear rates that are acceptable for coating by such processes without adverse effects on the quality of the photographic material being made; (c) are useful for forming layers, which have acceptable interlayer adhesion to neighboring layers, in a photographic material prepared by a conventional bead-coating or curtain-coating process; (d) are fairly Newtonian and have acceptable viscosities at concentrations of thickener which are sufficiently low to have no significant, adverse effect on sharpness or other sensitometric properties of the photographic material, in which a layer of the solution is provided as a source of hardener for the material; and (e) at concentrations of hardener, which are adequate for hardening the various layers of a photographic material after diffusion from one layer of the solution included in the material, and concentrations of the thickener, which are adequate for the viscosity and power law index characteristics described in (a) and (b), have a rate of reaction of thickener with hardener that is sufficiently low so that formation of polymeric slugs in the solution can be avoided before the solution can be layered or coated in making a photographic material in a bead-coating or curtain-coating process.

Thus, in one of its aspects, the invention is an aqueous solution comprising a fast-acting hardener and a thickener and having, at 40° C. and shear rates between about 1000 and 10,000 $sec^{-1}$, a viscosity from about 5 centipoise ("cp") to about 20 cp and a power law index of greater than about 0.90; and having a concentration of thickener of less than about 100 $mg/cm^3$ and, more preferably, less than about 50 $mg/cm^3$. (In employing the bead coating practice in accordance with the present invention, typically about 3.8 to about 5.0 (preferably about 4.39) $cm^3/ft^2$ of solution of the invention is coated in a layer. In employing the curtain coating practice, typically about 3.0 to about 3.6 (preferably about 3.30) $cm^3/ft^2$ of solution of the invention is coated in a layer.)

In another aspect, the invention is a method for hardening a photographic layer, comprising a colloidal carrier material, in a photographic material, which comprises a support material and at least one photographic layer coated over said support material, said method comprising placing in contact with at least one photographic layer of said photographic material a layer of a coating composition which (i) comprises a fast-acting hardener and a thickener; (ii) during the process of being placed in the photographic material, is an aqueous solution which, at 40° C. and shear rates between about 1000 and about 10,000 $sec^{-1}$, has a power law index of greater than about 0.90 and a viscosity of from about 5 cp to about 20 cp; and (iii) has a concentration of thickener of less than about 100 $mg/cm^3$ and more preferably less than about 50 $mg/cm^3$.

In the solutions and methods of the invention, the power law index limitation provides that the solutions, which are used to provide the "coating composition" layer as a source of fast-acting hardener in a photographic material, are nearly Newtonian and, consequently, not shear-thinning, while the viscosity limitation ensures uniform coatability in conventional coating methods used to make photographic materials.

The limitation on the concentration of thickener provides that the effect of a layer made with the composition on the sharpness or other sensitometric properties of a photographic material will be insignificant. Note that a lower limit on thickener concentration is implied by the lower limit on viscosity. Further, within the range of concentrations of thickeners in solutions of the invention, dictated by the limitation on the highest concentration and the lower limit that will provide the required minimum viscosity, there is suitable interlayer adhesion between a "coating composition" layer formed with a solution of the invention and other layers, typically photographic layers with gelatin as a "colloidal carrier material."

The concentration of fast-acting hardener in a solution of the invention is dictated by the amount necessary to harden all of the gelatin in all of the layers (typically between about 5 and about 20) of the photographic material, with which the solution is to be employed to provide hardener. In a preferred application, hardener will diffuse from a single "carrier composition" layer of solution of the invention to all of the other layers to harden the gelatin in the other layers. Typically, with Hardener Z, defined below, the weight of hardener that is provided will be between about 4% and about 6% of the weight of gelatin in all layers of the photographic material.

The concentration of thickener in a solution of the invention is dictated by the need to satisfy viscosity requirements for satisfactory coating of the layer or pack of layers with which the solution of the invention is provided to the photographic material.

While there is no strictly defined relationship between the amount of thickener and the amount of hardener that may be present in a solution of the invention, the concentrations of both must be low enough to preclude excessive premature reaction between components of thickener and hardener which could lead to coating defects.

With some of the thickeners that can be employed in accordance with the invention, the pH of the solution of the invention, of thickener with fast-acting hardener, can be adjusted by any conventional technique (e.g., addition of buffer solution, addition of strong acid, or the like) to advantageously slow the rate of crosslinking reactions between thickener and hardener. Some of the thickeners that can be employed in accordance with the invention are advantageously completely unreactive with some of the hardeners.

Typically, in preparing a solution of the invention, a solution of hardener is combined with a solution of thickener just prior to coating of the resulting solution of the invention in a photographic material. Prior to being coated on the photographic material, a layer of solution of the invention might be added to a pack of other layers, which is then deposited (i.e., coated) on the photographic material.

Typically, in accordance with the invention, there will be one "coating composition" layer formed with a solution of the invention among the layers in a photosensitive materials but this "coating composition" layer may not contain photosensitive materials (typically silver halide crystals), dyes, color couplers, sensitizers, or the like. In the typical situation, fast-acting hardener diffusing from the single "coating composition" layer will harden all of the "photographic layers," each of which will comprise a "colloidal carrier" material.

Other advantages and a fuller appreciation of the invention will be gained upon an examination of the following detailed description.

DETAILED DESCRIPTION

In the description of the invention in the present specification, process steps are carried out and concentrations measured at room temperature (about 20° C. to about 25° C.) and atmospheric conditions unless otherwise specified As used herein, the term "photographic layer" is meant to refer to any of a variety of layers coated successively, i.e., one on top of another, on a support to form a photographic material (e.g., paper or film); such layers include silver halide emulsion layers, protective layers, filter layers, intermediate layers, and undercoating layers and photographic auxiliary layers in general. Each of these layers will comprise a "colloidal carrier material," typically gelatin, and some other component, e.g., silver halide crystals, sensitizers, dyes, color couplers, or the like, of significance to the photographic process. In accordance with the invention, a layer of a "coating composition," which comprises a combination of a fast-acting hardener and thickener in accordance with the invention, will be placed among the layers in a photographic material made in accordance with the invention. As indicated above, the coating composition layer is not necessarily a photosensitive layer. The coating composition layer may occur as any of the layers in a photographic material. The "coating composition layer" is formed from an aqueous solution of the invention, which is the composition that is coated in the coating process to form the layer of the "coating composition" in a photographic material made in accordance with the invention.

In one of it aspects, the invention entails a method for hardening a photographic material, by which is meant hardening the "colloidal carrier material" of all of the photographic layers of the material.

The colloidal carrier material is typically gelatin, but can be a protein other than gelatin, a synthetic carrier vehicle, such as a water-soluble polymer, e.g., polyacrylate, dextran, alginic acid, and mixtures thereof, the molecules of which can be crosslinked to effect hardening.

Suitable fast-acting hardeners are, for example, those described in U.S. Pat. Nos. 4,067,741; 4,119,464; and 4,233, 398. The preferred fast-acting hardeners used according to the present invention are carbamoyl pyridinium compounds represented by Formula X:

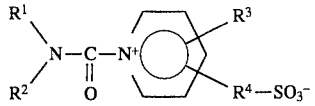

X wherein $R^1$ and $R^2$ are independently an alkyl having 1–3 carbons; a phenyl substituted with a lower alkyl having 1–3 carbons or a chloro or a bromo; a benzyl substituted on the phenyl ring with a lower alkyl having 1–3 carbons or a chloro or a bromo; or $R^1$, $R^2$ and the nitrogen to which both are bonded are unsubstituted piperidinyl or morpholinyl or piperidinyl or morpholinyl substituted at one carbon with an alkyl having 1–3 carbons or a chloro or a bromo; is hydrogen, methyl or ethyl; and $R^4$ is a single bond or alkylenyl of 1–3 carbon atoms. A particularly preferred hardener is 1-(4-morpholinylcarbonyl)- 4-(2-sulfoethyl)-pyridinium hydroxide inner salt, which is referred to herein as "Hardener Z".

Thickeners useful in accordance with the present invention are a chain-extended gelatin, provided that the pH of the aqueous solution coated to form the coating composition layer is less than about 4; a co-polymer, with a molecular weight between about 50,000 and about 1,000,000 daltons, of a compound of Formula XXXI

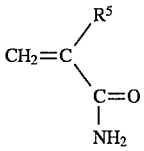

XXXI and a compound of Formula XXXII

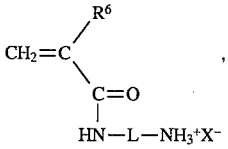

XXXII wherein $R^5$ and $R^6$ are each independently hydrogen or methyl, L is a linker which is a straight or branched alkylenyl having 1 to 5 carbons, and $X^-$ is a chloride ion or a bromide ion; a mixture of a gelatin with an isoelectric pH of between about 4.5 and 5.0 and a co-polymer, with a molecular weight between about 50,000 and about 1,000,000 daltons, of a compound of Formula XXXI and a compound of Formula XXXIII

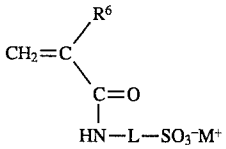

XXXIII wherein $R^6$ and L are as defined for the compound of Formula XXXII and $M^+$ is a metal ion; or a mixture of a gelatin with an isoelectric pH of between about 4.5 and 5.0 and a polyvinyl alcohol with a molecular weight between about 100,000 daltons and about 500,000 daltons. $M^+$ is preferably $Na^+$, and $X^-$ is preferably $Cl^-$. The co-polymers will typically have molecular weights of about 100,000–200,000 daltons. The polyvinyl alcohol will typically have a molecular weight of about 200,000–300,000 daltons.

In one embodiment, the thickener is an admixture of a gelatin having an isoelectric pH of about 4.5 to about 5.0 and a polyvinyl alcohol. Preferred for the admixture is a ratio by weight of polymer to gelatin of about 60:40, with the aqueous solution, which is coated to form the layer of coating composition in the photographic material, having a pH of about 3.

In another embodiment, the thickener is the copolymer of a compound of Formula XXXI wherein $R^5$ is hydrogen, and a compound of Formula XXXII, wherein $R^6$ is methyl, L is n-propylenyl, and r is $Cl^-$ (i.e., a copolymer of acrylamide and N-(3-aminopropyl) methacrylamide hydrochloride) and between about 65% and about 85% of the mass of the co-polymer is from the compound of Formula XXXI. Preferred are the copolymers in which 70%–80% of the mass is from the compound of Formula XXXI.

In yet another embodiment, the thickener is an admixture of a gelatin having an isoelectric pH of about 4.5 to about 5.0 and a copolymer of acrylamide and 2-acrylamido-2-methylpropane sulfonic acid sodium salt, i.e. a copolymer of the compound of Formula XXXI, wherein $R^5$ is hydrogen, and the compound of Formula XXXIII, wherein $R^6$ is hydrogen, L is 1,1-dimethylethylenyl ($—C(CH_3)_2CH_2—$), wherein carbon-1 of the ethylenyl is bonded to nitrogen, $M^+$ is $Na^+$, and wherein about 20% to about 30% of the mass of the copolymer is from the compound of Formula XXXI. Preferred is an admixture in which the ratio by weight of copolymer to gelatin is 20:80. Advantageously the aqueous solution which is coated to form the layer of coating composition in the photographic material has a pH of about 6.

In a further embodiment, the thickener is a chain-extended gelatin. Chain-extended gelatin is a soluble, high molecular weight gelatin which is prepared by reacting gelatin in solution with a cross-linking agent at a sufficiently low concentration that the average molecular weight of the gelatin molecules is increased (as a consequence of cross-linking) without gelatinization or insolubilization of the gelatin. In making chain-extended gelatin, conventional cross-linking agents, such as bis-(vinylsulfonyl)methane, can be used. It has been found that a chain-extended gelatin made by reacting gelatin in aqueous solution at about 6.0% (w/w) to about 18.0% (w/w) with from about 0.25 millimoles to about 5 millimoles of bis-(vinylsulfonyl)methane per 100 grams of gelatin to yield a solution with a Brookfield viscosity (i.e., viscosity at 0 $sec^{-1}$ shear rate measured with a Brookfield LVTD viscometer with a UL adaptor) at 40° C. of about 25 cp to about 30 cp is suitable as a thickener for use in accordance with the invention. The aqueous solution which is coated to form the layer of coating composition in the photographic material, when the thickener is chain-extended gelatin, has a pH of below about 4 and preferably at about 3.

One problem encountered with gelatin-containing thickeners, including chain-extended gelatin, at low pH's, particularly below about 3, is reduction in viscosity due apparently to acid hydrolysis of the gelatin. This problem can be minimized by combining chain-extended gelatin, acid, and fast-acting hardener to form an aqueous solution of the invention as closely as possible in time before use of the solution in coating a layer into a photographic material. For example, a chain-extended gelatin solution might be triple mixed with acid and fast-acting hardener solution to form the aqueous solution of the invention just before coating.

As indicated above, aqueous solutions of the invention are prepared by combining in water a fast-acting hardener, a thickener and, optionally, other substances, such as acid or buffer to set the pH of the solution at a suitable value.

The concentrations of hardener and thickener in a solution according to the invention depend on a number of factors. Generally the concentration of thickener will be set to achieve an appropriate viscosity in the solution taking into consideration the process being employed to coat the solution into the photographic material. A conventional bead-coating process will require a viscosity, at 40° C. and shear rates of 1000–10,000 $sec^{-1}$, of at least about 5 cp, and preferably at least about 7 cp, while a conventional curtain-coating process will require a somewhat higher viscosity, typically at least about 10 cp, and preferably at least about 12.5 cp, at 40° C. and shear rates of 1000–10,000 $sec^{-1}$. The thickeners that may be employed in accordance with the invention are those whose aqueous solutions can achieve such viscosities at concentrations (at room temperature) of less than about 100 $mg/cm^3$ and, at the same time, satisfy the requirement that the solutions be at least fairly Newtonian at shear rates between about 1000 $sec^{-1}$ and 10,000 $sec^{-1}$ at 40° C. Thickeners of the invention will provide fairly Newtonian solutions with such viscosities preferably at concentrations (at room temperature) below about 50 $mg/cm^3$. The concentration of the hardener will be set by considering the nature of the "colloidal carrier material" which is to be hardened with the fast-acting hardener provided from the solution, the number and thicknesses of the layers comprising colloidal carrier material to be hardened in the photographic material, and the particular thickener and hardener used.

In addition to gelatin as the "colloidal carrier material" in photographic materials prepared in accordance with the invention, other proteins and polymers, which contain carboxyl groups and amine groups, through which crosslinking among polymer molecules can occur, may be employed as such materials.

Among the photographic layers which are particularly suitable for the hardening process according to the present invention are gelatin layers for various black-and-white and color photographic films, especially layers used for carrying out color photographic processes, e.g., those containing color couplers or designed to be treated with solutions containing color couplers.

In accordance with the present invention, the aqueous solution comprising fast-acting hardener and thickener is applied as an additional or carrier layer in addition to the layers, generally photographic layers, otherwise present in the photographic material. While the carrier layer may also function as a photographic layer, as indicated above, it is preferably not also a photographic layer. The carrier layer can be placed in any position among the other layers in the photographic material, e.g., the carrier layer can be applied over the cyan layer or over the magenta layer or under the yellow layer. The carrier layer can be provided as one layer of a "pack" of other layers (e.g., a yellow "pack"), as understood in the art. The hardener diffuses out of the carrier layer and into the other layers, where it reacts with molecules of the colloidal carrier material (usually gelatin) and thereby causes hardening.

Any of the usual methods for preparing photographic materials by coating layers successively beginning with a layer coated on a support material can be employed for preparing a photographic material with a layer of fast-acting hardener/thickener in accordance with the invention. Those skilled in the art will be familiar with coating methods commonly used in photography, especially the bead coating process and apparatus for practicing the process as described, for example, in U.S. Pat. Nos. 2,761,417; 2,681,294; and 4,525,392; or the curtain coating process and apparatus for practicing the process illustrated, for example, in U.S. Pat. Nos. 3,632,374 and 4,569,863. In employing the bead coating practice in accordance with the present invention, typically about 3.8 to about 5 $cm^3/ft^2$ of solution of the invention (e.g., 4.39 $cm^3/ft^2$) is coated in a layer. In employing the curtain coating practice, typically about 3–3.6 $cm^3/ft^2$ of solution of the invention is coated in a layer (e.g., 3.30 $cm^3/ft^2$).

The advantages of the aqueous solutions in accordance with the present invention are partly attributable to the fairly Newtonian behavior of the solutions in response to changes in shear rate. In the process of preparing a photographic material, coating compositions are subjected to shear, for example, coating hopper shear rates of more than 2700 $sec^{-1}$ and shear rates in excess of 100,000 $sec^{-1}$ outside of the hopper. A change in viscosity with increasing shear rate affects coatability of a composition. It has been found that suitable coating compositions for delivery of a fastacting hardener to a photographic material are fairly Newtonian, i.e., viscosity remains substantially constant with increasing shear rate. Shear-thinning coating compositions lead to non-uniform coatings. The power law index (PLI) is a convenient way of quantitatively expressing how nearly Newtonian a composition is. PLI for a composition of interest equals 1 minus the slope of the curve of log viscosity vs. log shear rate. PLI for a particular composition will be a function of shear rate and temperature (and other factors of lesser significance). If the PLI of a composition is 1.00, the material is Newtonian; if PLI is less than 1.00, the material is shear thinning. It has been found that an aqueous solution which has a viscosity of at least 5 cp at 40° C. at shear rates between about 1000 $sec^{-1}$ and about 10,000 $sec^{-1}$ (for bead coating) and a viscosity of at least 10 cp at 40° C. at shear rates between about 1000 $sec^{-1}$ and about 10,000 $sec^{-1}$ (for curtain coating) and a PLI of equal to or greater than 0.90 at 40° C. at shear rates between about 1000 $sec^{-1}$ and about 10,000 $sec^{-1}$ will not give rise to coatability problems, such as non-uniform coating, in preparation of a photographic material using the solution as the coating composition for one of the layers.

A further important parameter of the fast-acting hardener-containing coating compositions (i.e., aqueous solutions) of the present invention is initial viscosity (i.e., viscosity at 0 $sec^{-1}$ shear rate). The fast-acting-hardener-containing coating compositions of the invention include thickener to provide an initial viscosity that is preferably in the range of about 5 cp to about 20 cp at 40° C. Coating compositions with initial viscosities outside this range tend to be either too thin or too thick for proper coating and result in non-uniform coatings, when conventional coating apparatuses are used and a coating composition layer is placed in a photographic material as illustrated in the Examples.

Another physical attribute of significance to the fast-acting-hardener-containing coating compositions of the present invention is the concentration of thickener. On the one hand, the concentration of thickener must be high enough to provide the necessary (or desirable) viscosity. On the other hand, a concentration which is too high results in the deposition of too much material in the photographic layer with possible concomitant adverse effects on sharpness or other sensitometric properties, such as minimum or maximum density, speed, or contrast, of the photographic material. With thickener concentration below about 50 $mg/cm^3$ (at room temperature) in a solution of the invention, there are negligible adverse effects on sensitometric properties of photographic materials prepared with the solution.

The present invention is further explained by the following examples, which should not be construed to limit the scope of the invention.

PREPARATIVE EXAMPLE 1

Preparation of copolymer of acrylamide and N-(3-aminopropyl)-methacrylamide in a weight ratio of 80:20: To a five gallon Pfaudler reactor was added 15,000 g of distilled water and the contents were purged with nitrogen for twenty minutes. 1440 g of acrylamide and 360 g of N-(3-aminopropyl)methacrylamide hydrochloride were then added and the contents were warmed to 60° C. 13.0 g of potassium persulfate and 2.60 g of sodium metabisulfite were added and the contents were stirred at 60° C. under nitrogen for 16 hours. The reactor was cooled to give a viscous solution which was diafiltered through a 20K polysulfone membrane for five turnovers. The polymer solution was concentrated on the diafilter to 10% solids and isopropyl alcohol was added to 2% concentration to prevent bacterial growth. The polymer had an inherent viscosity (i.e., intrinsic viscosity) of 0.85 in 1M aqueous sodium chloride.

In other syntheses as described in this preparative example, polymers with inherent viscosities in 1M NaCl of 0.94–1.03 were obtained.

PREPARATIVE EXAMPLE 2

Preparation of copolymer of acrylamide and 2-acrylamido- 2-methyl propane sulfonic acid sodium salt in weight ratio of 20:80: To a five gallon Pfaudler reactor was added 9500 g of distilled water. The water was purged with nitrogen for twenty minutes and then heated to 60° C. To a three gallon header tank was added 5275 g of distilled water, 475 g of acrylamide and 3278 g of 58% sulfonic acid sodium salt. The header contents were purged with nitrogen for twenty minutes. 7.5 g of potassium persulfate was added to the 5 gallon Pfaudler reactor followed by the addition of the contents of the header over a period of 1 hour. The contents of the reactor were stirred at 60° C. under nitrogen for 16 hours and then cooled to give a clear viscous solution. The polymer solution was diluted with 5 gallons of water, diafiltered though an "O"K polysulfone permeator for 5 turnovers and concentrated to 12% solids. The polymer had an inherent viscosity of 1.40 in 1M aqueous NaCl. Isopropyl alcohol was added to a concentration of 2% to prevent bacterial growth.

PREPARATIVE EXAMPLE 3

Preparation of chain-extended gelatin: Sufficient lime-processed, bone gelatin was added to distilled water at room temperature in a 20 gallon glass-lined reactor so that the final gelatin concentration, when all of the ingredients of the reaction had been added, was 12.5 weight percent. This gelatin mixture was vigorously stirred for several minutes, then the stirring was stopped to allow the gelatin to swell for 30 minutes. Next the gelatin mixture was heated to 45° C. (±2° C.) to allow the gelatin to dissolve without stirring and held at this temperature for 20 minutes. The gelatin solution was then stirred mildly for 30 minutes, by which time all of the gelatin had dissolved and a solution of uniform consistency was achieved. An aqueous solution of bis-(vinylsulfonyl)methane was then added such that the concentration of this compound was 0.063 weight percent (2.55 millimoles per 100 grams of gelatin). The resulting solution was stirred vigorously for 2 minutes, and the pH was adjusted to 5.7 using either 1N sulfuric acid or 1N sodium hydroxide as needed. Mixing speed was then reduced so that the stirring became very mild, and the reaction was permitted to proceed for 4 hours. The reaction mixture was then removed from the reactor and reduced in temperature to 5° C. The final product contained no insolubles, was stable on storage under refrigeration until used, and liquified readily when heated to 40° C.

In the following examples, the hardener used was fast-acting Hardener Z ((1-(4-morpholinylcarbonyl)-4-(2-sulfoethyl)-pyridinium hydroxide inner salt), which is the compound of Formula X wherein $R_1$ and $R_2$, together with the nitrogen to which they are both bonded, are unsubstituted morpholinyl; $R_3$ is hydrogen; and $R_4$ is para to the pyridinium nitrogen and is $—(CH_2)_2—$. pHs are adjusted conventionally, with addition of strong acid (e.g., hydrochloric, sulfuric, nitric) or base (e.g., sodium hydroxide) as required. Viscosities were determined at 40° C. using a Haake RV12 viscometer equipped with an NV sensor system or an HS 1 high shear sensor. The NV sensor system can measure viscosities at shear rates up to 2770 $sec^{-1}$ and the HS 1 system up to about 27,000 $sec^{-1}$ provided the composition had a viscosity of at least 10 cp. Unless otherwise noted, viscosities provided in the examples are determined at 2770 $sec^{-1}$. Reactivity of the hardener with the thickener was measured as the rise in viscosity with time, as the hardener crosslinks the thickener. The rise is viscosity was monitored by a Brookfield LVTD viscometer with a UL adaptor at 40° C. The data were plotted as (1/viscosity) versus time. A linear regression was fitted to the straight line portion of the curve which had the steepest slope; the x-axis intercept of the line determined by this linear regression was taken as "reactivity" or "gelation time" with the hardener.

EXAMPLE 1

Coating compositions were prepared by diluting in distilled water the copolymer, prepared as described in Preparative Example 1, having an inherent viscosity of about 1.00. The solution concentrations, viscosities, PLIs, pH's and reactivities are given in Table I.

TABLE I

Properites of Coating Compositions (as Aqueous Solutions) of Example 1*

| % Wt Co-Polymer | Viscosity at 40° C., cp | PLI | pH | Reactivity with hardener (min.) |
|---|---|---|---|---|
| 2.1 | 7 | 0.99 | 5.5 | infinite |
| 3.55 | 12.5 | 0.99 | 5.5 | infinite |

*Copolymer of acrylamide (80 wt. %) and N-(3-aminopropyl) methylacrylamide hydrochloride (20 wt. %), inherent viscosity (1 M NaCl) of approx. 1.00.

Note that the copolymer of this Example contains only amino groups and no carboxyl groups and is, thus, unreactive with the hardener which crosslinks carboxyl groups only to amino groups.

EXAMPLE 2

This example illustrates properties of a photographic material prepared with hardener-containing coating compositions prepared with the copolymer of Preparative Example 1 having an inherent viscosity of approximately 1.00.

Sample strips of a multilayer, tri-color photographic material (similar to KODAK Ektachrome$^R$ film) were prepared by bead coating using a slide hopper. In the preparation, three packs of layers were coated in succession on a standard support material. The bottom layer of the third pack applied (i.e., the layer which, in the photographic material, is in contact with the top layer of the second pack) was an extra (fifth) layer in this top (i.e., third) pack and consisted of the presently described coating composition (including fast-acting hardener). All of the other layers, in all of the packs, were gelatin-containing layers. The top pack included a fast-yellow layer, a slow yellow layer, and other layers which did not include silver halide. The slow yellow layer was under and in contact with the fast yellow layer, and the extra carrier layer (consisting of the presently described coating composition) was under and in contact with the slow yellow layer. The entire coating was hardened with fast-acting hardener diffusing from the extra carrier layer.

Copolymers for the extra layer were prepared generally as described in Preparative Example 1 except that the weight ratios of monomers were varied. Coating compositions were prepared by mixing an aqueous solution (pH 3.5, adjusted with nitric acid)) of 5.09 wt. % fast-acting hardener with an aqueous solution (pH 3.5) of each copolymer immediately prior to coating the extra layer as part of the yellow pack. The yellow pack was applied on top of an unhardened "rug" consisting of the other two packs, a cyan pack in contact with the support material and a magenta pack over the cyan pack. For a copolymer solution of 2.22 wt. % solids, the coated weight of the co-polymer was 50 mg/ft$^2$. The coated weight of fast-acting hardener was 88.6 mg/ft$^2$ to provide hardener through diffusion to the gelatin-containing layers of the coating at 5% of the weight of the total gelatin in those layers. The copolymer solution and hardener solution were mixed in a volume ratio of 2.25 cc/ft$^2$ to 1.75 cc/ft$^2$ immediately prior to coating.

For comparison, a photographic material was provided that was the same as that just described in this Example except that the copolymer-containing layer was omitted and hardener was simply mixed in with the slow yellow layer at a level of 5% of the weight of the total gelatin in all the layers of the coating.

The photographic materials with the experimental coating composition layers were tested after several weeks for interlayer adhesion by the roller wet stripping test and for mushiness. The roller wet stripping test consists of inscribing a mark across a piece of film which is then soaked in developer solution and inserted wet between drive rollers. The film is transported through the rollers and, part way through, the roller in contact with the emulsion side (i.e., the coating) is stopped while the other roller continues to feed film. Any delamination or "stripping" from the scribe mark is evaluated visually and rated on a scale of 0–10, with low ratings indicating better performance. In the mushiness test, a stylus with gradually increasing weight is moved across a photographic material and the weight in grams required to break (or "plow") through the coated layers is the mushiness value. A higher mushiness value represents a harder coating.

TABLE II

Interlayer Adhesion and Mushiness (Film with and without Coating Composition Layer with Co-Polymers of Acrylamide and N-(3-Aminopropyl)-Methylacrylamide)

| Ratio of mass of acrylamide to mass of N-(3-aminopropyl)-methylacrylamide hydrochloride | Roller Wet Stripping (rating) | Mushiness (g to plow) |
|---|---|---|
| 90/10 | 5,7 | 47 |
| 85/15 | 0 | 103 |
| 80/20 | 0 | 109 |
| 70/30 | 0 | 116 |
| Control (hardener in yellow layer) | — | 115 |

The results given in Table II demonstrate good interlayer adhesion and acceptable mushiness for the copolymers in which the weight fraction of acrylamide is at least 0.50 and, more preferably, between about 0.65 and about 0.80. Sensitometric evaluation showed only small perturbations produced by inclusion of these carrier layers in the photographic material samples.

EXAMPLE 3

Coating compositions-were prepared by mixing fast-acting hardener with a thickener solution of gelatin having an isoelectric pH of 4.8 and a co-polymer prepared as described in Preparative Example 2 except having a weight ratio of monomers of 25 parts acrylamide to 75 parts sodium 2-acrylamido-2-methylpropane sulfonate. The pH of thickener solution was adjusted to 6.1; a precipitate forms in the thickener solution below the isoelectric pH of the gelatin. Properties of thickener solutions, which included initially fast-acting hardener at 2.5% of the weight of gelatin plus co-polymer, are given in Table III.

TABLE III

Properties of Solutions of Example 3 (Thickener: Gelatin (isoelectric pH 4.8) with Copolymer of Acrylamide (25%) and Sodium 2-Acrylamido-2-Methylpropane Sulfonate (75%), pH = 6.1, Fast-Acting Hardener Initially Present at 2.5% of Weight of Solids in Thickener)

| % Wt Co-Polymer | % Wt Gelatin | Viscosity at 40° C., cp | PLI | Reactivity with Hardener (min.) |
|---|---|---|---|---|
| 0.5 | 2.0 | 7.0 | 0.95 | 180 |
| 0.85 | 3.4 | 12.5 | 0.95 | 15 |

A photographic material was prepared as described in Example 2 employing a coating composition made by mixing, just prior to coating, a thickener solution with a pH of 6.1 and a weight ratio of gelatin to the copolymer of this example of 4:1, and a solution of fast-acting hardener (5.09 wt. %) with a pH of 3.5. The volumes of the two solutions that were mixed were such that they provided, in the resulting coating composition, 16 mg/ft$^2$ copolymer, 64 mg/ft$^2$ gelatin, and fast-acting hardener at 91.8 mg/ft$^2$ (5% of the weight of the gelatin in all gelatin-containing layers of the coating). The tests described in Example 2 were carried out on the photographic material with the coating described in this paragraph, and the results showed good interlayer adhesion and no adverse sensitometric effects.

EXAMPLE 4

Coating compositions were prepared with fast-acting hardener and thickener which consisted of polyvinyl alcohol and gelatin. The polyvinyl alcohol was of high molecular weight, between about 250,000 and about 300,000 daltons, water-soluble, and fully hydrolyzed (>99.0%) and obtained from E. I. du Pont de Nemours & Co., Inc. (Wilmington, Del., USA) under the trademark ELVANOL 73–125. A4 wt. % aqueous solution of the ELVANOL 73–125 polyvinyl alcohol had a viscosity of 115–135 cp when measured by the Hoeppler falling ball method at 20° C. The gelatin had an isoelectric pH of 4.8. Thickener solutions were prepared in which the weight ratio of polymer to gelatin was 60/40, hardener was present initially at 2.5% of the weight of polymer plus gelatin, and the pH was initially 5.5 or 3.0. Properties of these solutions are given in Table IV.

TABLE IV

Properties of Aqueous Solutions of Example 4 (Thickener: Polyvinyl Alcohol/Gelatin: 60/40; Fast-Acting Hardener Present Initially at 2.5% of Weight of Polymer Plus Gelatin

| pH | Gelatin % Wt. | Viscosity at 40° C. cp | PLI | Reactivity with Hardener (min.) |
|---|---|---|---|---|
| 5.5 | 1.2 | 7.3 | 0.98 | 131 |
| 3.0 | 1.0 | 7.0 | 0.97 | infinite |
| 5.5 | 1.5 | 12.5 | 0.95 | 56 |
| 3.0 | 1.3 | 12.5 | 0.99 | 173 |

Photographic materials were prepared as described in Example 2 with coating compositions of this Example to test the properties of the resulting coatings when different ratios of polyvinyl alcohol to gelatin were employed as thickener but the dry lay-down of thickener in the additional layer was kept constant at 50 mg/ft$^2$. The thickener solution was combined with hardener solution just prior to coating, and hardener was provided in sufficient quantity to provide hardener at 5 of the weight of gelatin in all layers of the coating. The adhesion and mushiness tests were carried out on the resulting photographic materials as described in Example 2. It was found that a weight ratio of polyvinyl alcohol/gelatin of from about 45:55 to 65:35 was needed for good interlayer adhesion. Mushiness (hardness) was not dependent on this weight ratio.

EXAMPLE 5

Aqueous solutions of hardener and the chain-extended gelatin of Preparative Example 3 were prepared. To minimize reactivity of the hardener and the chain-extended gelatin, aqueous solutions of each were prepared separately and adjusted to pH 3 by the addition of 1N sulfuric acid. These two solutions were then mixed in the appropriate weight ratio in order to obtain the desired concentrations of hardener and chain-extended gelatin. Both pH and viscosity of the resultant solutions were measured continuously. Initially the viscosity remained relatively constant, but the pH of the solution rose slowly due to the release of morpholine as a by-product of the first step in the reaction of the hardener with gelatin. When the pH of the solution approached 4, the viscosity began to increase more rapidly. The data presented in Table V were from an analysis of the viscosity measurements taken during the course of the reaction.

TABLE V

Properites of Solutions for Coating Compositions with Chain-extended Gelatin as Thickener Initial pH = 3

| Gelatin Wt. % | Hardener Wt. % | Viscosity at 40° C. cp | PLI | Reactivity with Hardener (min.) |
|---|---|---|---|---|
| 2.3 | 0.058 | 7 | 0.90 | 100 |
| 3.8 | 0.095 | 12.5 | 0.9 | 72 |

When photographic materials including coating compositions corresponding to a solution of this Example were evaluated for interlayer adhesion and sensitometric quality as described in Example 2, good interlayer adhesion and no adverse sensitometric effects were found.

While the present invention has been described and exemplified herein with some specificity, those skilled in the art will appreciate the various modifications and variations that may be made in what has been disclosed herein without departing from the spirit of the invention. It is intended that such modifications and variations also be encompassed by the present invention and that the scope of the present invention be limited solely by the broadest interpretation that lawfully can be accorded the appended claims.

We claim:

1. A method of hardening all of the photographic layers in a photographic material, which consists of one or more photographic layers coated over a layer of support material and wherein all of the photographic layers comprise gelatin as the colloidal carrier material, which method comprises placing in contact with at least one of the photographic layers a coating composition layer which (i) comprises a fast-acting hardener and a thickener, which is a co-polymer, with an average molecular weight between about 50,000 and about 1,000,000 daltons, of acrylamide and N-(3-aminopropyl)methylacrylamide hydrochloride wherein from about 70% to about 85% of the mass of the co-polymer is from acrylamide; (ii) during the process of being placed in the photographic material, is an aqueous solution which, at 40° C. and shear rates between about 1000 and 10,000 $sec^{-1}$, has a power law index of greater than about 0.90 and a viscosity of from about 5 cp to about 20 cp; and (iii) has a concentration of said thickener of less than about 50 $mg/cm^3$.

2. The method of wherein said coating composition layer is not also a photosensitive layer and said fast-acting hardener is present in said aqueous solution, which is employed to place said coating composition in said photographic material, at from about 1% to about 10% of the weight of the gelatin in all of the photographic layers and is a carbamoyl pyridinium compound of Formula X:

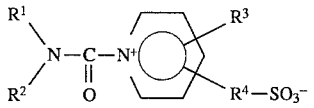

X wherein $R^1$ and $R^2$ are independently an alkyl having 1–3 carbons; a phenyl substituted with a lower alkyl having 1–3 carbons or a chloro or a bromo; a benzyl substituted on the phenyl ring with a lower alkyl having 1–3 carbons or a chloro or a bromo; or $R^1$, $R^2$ and the nitrogen to which both are bonded are unsubstituted piperidinyl or morpholinyl or piperidinyl or morpholinyl substituted at one carbon with an alkyl having 1–3 carbons or a chloro or a bromo; $R^3$ is hydrogen, methyl or ethyl; and $R^4$ is a single bond or alkylenyl of 1–3 carbon atoms.

3. The method of claim 2 wherein the fast-acting hardener is 1-(4-morpholinylcarbonyl)-4-(2-sulfoethyl)-pyridinium hydroxide inner salt.

* * * * *